United States Patent [19]

Kornylak, deceased

[11] Patent Number: 5,029,423

[45] Date of Patent: Jul. 9, 1991

[54] VIBRATION RESISTANT BUILDING CONSTRUCTION

[75] Inventor: Andrew T. Kornylak, deceased, late of Hamilton, Ohio, by Lucille Kornylak, legal representative

[73] Assignee: Kornylak Corporation, Hamilton, Ohio

[21] Appl. No.: 426,152

[22] Filed: Oct. 24, 1989

[51] Int. Cl.[5] ..... E02D 27/34; E02D 27/46; E04H 9/02

[52] U.S. Cl. ..... 52/293; 52/220; 52/234; 52/167 R

[58] Field of Search ..... 52/293, 294, 295, 220, 52/167, 234

[56] References Cited

U.S. PATENT DOCUMENTS

| | | | |
|---|---|---|---|
| 2,610,710 | 9/1952 | Shannon | 52/295 |
| 2,968,374 | 1/1961 | Bohnsack | 52/293 X |
| 3,170,269 | 2/1965 | Dunnington | 52/293 |
| 3,217,452 | 11/1965 | Steele | 52/293 X |
| 3,411,252 | 11/1968 | Boyle | 52/295 X |
| 3,420,016 | 1/1969 | Findlay | 52/293 |
| 3,893,271 | 7/1975 | Kotlarz | 52/220 X |
| 4,470,232 | 9/1924 | Condevaux | 52/220 |

*Primary Examiner*—Richard E. Chilcot, Jr
*Assistant Examiner*—Robert Canfield
*Attorney, Agent, or Firm*—Fay, Sharpe, Beall, Fagan, Minnich & McKee

[57] ABSTRACT

A building that can be constructed quickly in a wide variety of configurations has a sill beam that runs along the perimeter of the building. The plumbing, electrical and other utility needs for the building are channeled through a cavity provided for in the sill beam. Columns are removably mounted on the sill beam according to the desired configuration with exterior and interior panels extending between the columns. Overhead, roof beams extend between columns with roof panels extending between the roof beams. Similarly, the floor is constructed of a plurality of floor panels. The panels forming the exterior walls of the building are pre-finished on both sides. The building can withstand earthquakes and other large vibrations caused by operating heavy machinery or blasting by isolating the mass of the panels extending between the columns with a mounting flange arrangement that provides a sealed connection between the columns and panels, but that allows relative movement between them if the building is subjected to vibrations.

16 Claims, 5 Drawing Sheets

VIBRATION RESISTANT BUILDING CONSTRUCTION

BACKGROUND OF THE INVENTION

1. Field of the Invention

The invention relates to a building constructed of panels mounted to a framework. The panels are of the pre-finished type so that construction of the building is nearly completed as soon as the panels are assembled to the framework. Also, the invention relates to a building constructed to withstand ground vibration caused by earthquakes, for example.

2. Description of the Prior Art

Panels having an insulating core of urethane or cyanurate have been produced with rigid skins on both sides of the core so that the panels are suitable for exterior and interior wall surfaces of a building. Also, a variety of paper, metal or plastic honeycomb or other space materials have been used as the core material for the panels. Accordingly, panels have been developed that can be used in roofing and flooring in the construction of a building.

A problem arises, however, in assembling the panels to construct a building quickly, efficiently and with a minimum of skilled labor involved in erecting the building. In this regard, a need has arisen to provide buildings that can be constructed quickly and easily for temporary or for permanent use, but without the need for an extensive construction operation for completing the building.

A further need persists to provide a framework for joining panels that constitute flooring, roofing, and walls, that can withstand ground vibrations caused by earthquakes, blasting, heavy machinery, or the like. Also, there is a need to develop a building that can be constructed in hot and cold climates and that can be cooled or heated efficiently. Further, in remote areas, where commercial power is not available, or in areas where construction begins, an adequate supply of power may not be available to construct the building, or to control the climate of the building's interior Therefore, buildings are necessary that can be constructed with a minimal amount of power equipment and that are energy efficient once complete.

In the construction of temporary or modular housing, it is often a problem that such temporary or modular buildings can be constructed of only a given dimension or configuration that is related to the building supplies available from which the building is to be constructed. The standardization of the prefabricated or modular building components enables the manufacturing of a minimum number of building components, but creates the associated problem of limiting the possible configurations in the building's design. In some instances, the limited options of configuration and design of the completed building diminishes the desire for the construction of buildings from prefabricated components, thus limiting the marketability of such prefabricated buildings.

SUMMARY OF THE INVENTION

It is an object of the invention to provide a building that can be constructed in a wide variety of configurations and designs from panels that constitute the walls, flooring, and roofing of the building by providing a framework that joins the panels together to form the building. It is a further object to provide a framework that permits wall panels to be mounted adjacent columns of the building to permit relative movement between the wall panels and the building columns, and to isolate the mass of the panels from the columns so that the completed structure can withstand vibrations from earthquakes, explosions, heavy machinery, and the like.

It is a further object of the invention to provide a building that is suitable for hot and cold climates wherein the walls, floors, and roof of the building are formed from materials having an insulated core that are joined together with metal framework components that have a high degree of structural strength, but that are also provided with an insulated core. It is known that metal frame members provide strength in the framework of a building, but metal has the drawback of having a high coefficient of heat transfer and also a low degree of noise absorption. Accordingly, it is an object of the invention to provide a two piece column member for erecting the building of the present invention that includes outer and inner metal shells bonded together by an insulating and bonding core that provides a thermal break in the column structure, and also provides a sound absorbing media in the metal column structure.

It is an object of the invention to provide a framework for a building that may take the form of a variety of floor plans and configurations by securing the columns in any desired location along a sill that is supported on either a spot or continuous footing. It is a further object of the invention to provide a sill on which the columns can be securely removably mounted at any desired location with means not visible from the exterior or interior of the building. The columns are secured to the sill against relative movement, but can be easily unmounted from the sill so that the position of the column can be changed if reconfiguration or dismantling of the building is desired.

It is an object of the invention to provide a framework for a building structure that includes a sill, a plurality of columns, and a plurality of roof beams that each have a cavity therein to accommodate electric, gas, and plumbing lines. It is a further object of the invention to assemble these framework components of the building so that the cavities provided in the sill, column, and roof beam members are interconnected to form a raceway through which the electric, gas, plumbing and like lines for the building can be routed.

It is a further object of the invention to provide a building that can be constructed with an unskilled labor force and with a minimum requirement for power tools. Accordingly, the panels are pre-finished to reduce post-erection work. This includes providing panels that are mounted between columns of the framework that include doors and windows, so that, if desired, the cutouts for the doors and windows do not have to be made in the panels during the building construction process. This eliminates the potential need for power tools on the construction site, if commercial power is not available.

It is a further object of the invention to provide a framework for constructing a building wherein interior walls of the building can be changed by replacing individual panels that constitute the walls without disturbing adjacent panels so that a minimum amount of disruption is caused in the building when the interior configuration of the building is changed.

DETAILED DESCRIPTION OF THE PREFERRED EMBODIMENT

Figure 2:
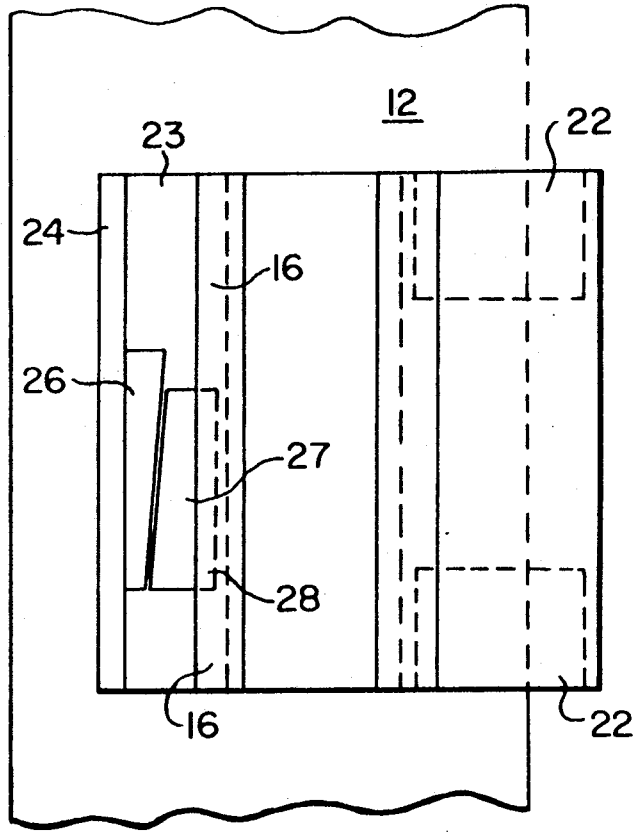
FIG. 2 is a view of the column and sill mounting connection taken along line 2—2 of FIG. 2.
Figure 1:
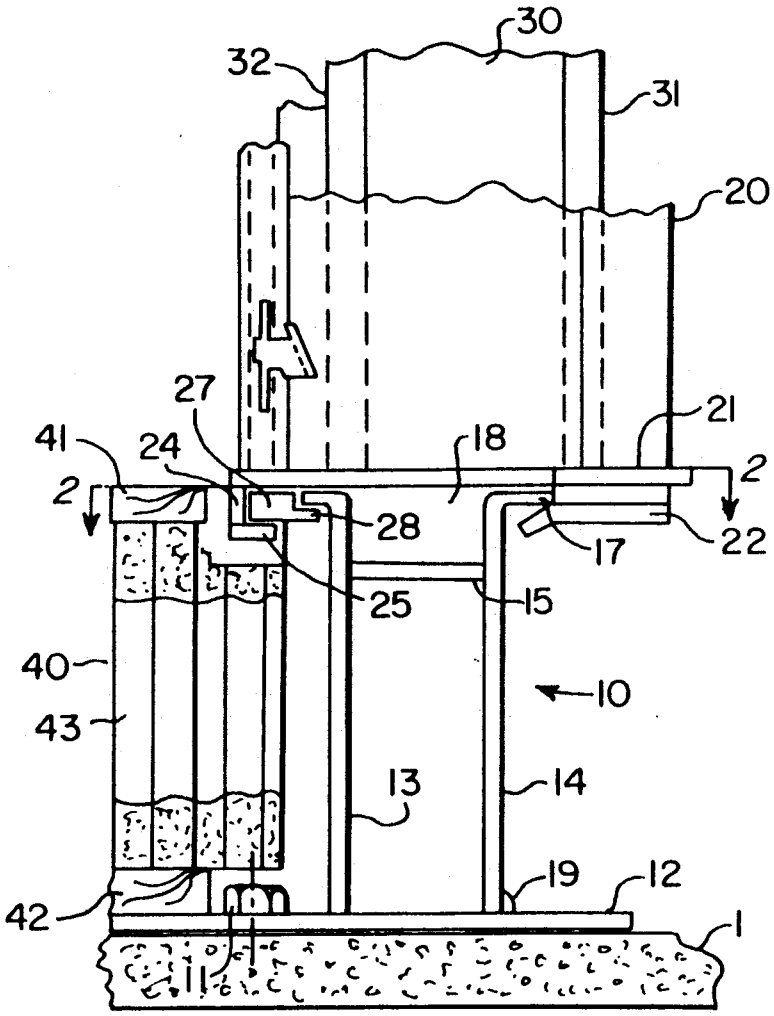
FIG. 1 is a plan view partly in section of a portion of a building constructed according to the present invention.
Figure 3:
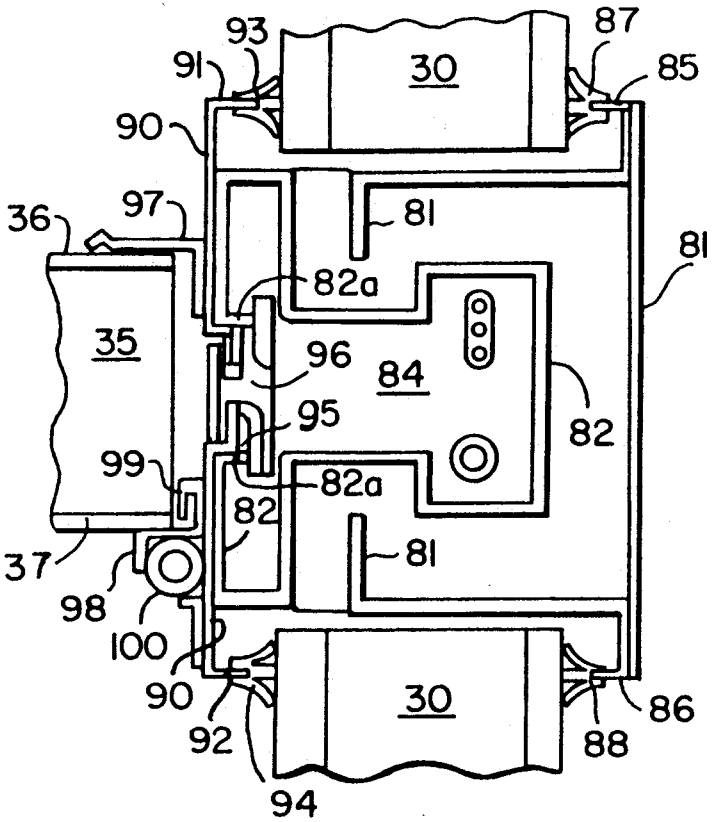
FIG. 3 is a cross-sectional view of a column and panel mounting assembly of a building constructed according to the present invention.

As shown in FIGS. 1-3, a building constructed according to the present invention is constructed on top of a footing 1. The footing is either a spot or continuous footing to which is bolted a sill or foundation beam 10 by a bolt 11 in a conventional manner. A plurality of columns 20 are secured at desired locations to the sill. The columns support exterior panels or walls 30 and interior panels or partitions 35.

The sill 10 is continuous about the periphery of the building and has a base plate or bottom flange 12 that is also continuous about the perimeter of the building. The upstanding portion of sill 10 is preferably of an H-beam shape having legs 13 and 14 that are spanned by a cross tie 15. Running along the top of sill 10 are top mounting flanges 16 and 17 which are used to secure columns 20 to the sill 10. A space or cavity 18 is formed above the cross tie 15 between the legs of the sill that is used for accommodating plumbing, electric, gas and like lines. Sill 10 is preferably constructed of steel. Accordingly, the sill can be fabricated by welding legs 13, 14 to base plate 12 as shown at 19. Cross tie 15 can also be welded between the legs of sill 10 or otherwise suitably secured in a manner to form the enclosed cavity 18.

A building constructed according to the present invention may have any of a variety of designs or configurations. The footing is poured in accordance with the desired exterior perimeter of the building and the sill 10 is secured to the footing. Preferably, sill 10 is comprised of a number of beam sections that are joined together and secured to the footing to create the continuous perimeter of the building.

In accordance with the present invention, the columns can be secured in any desired location along the perimeter of the building to accommodate various designs for mounting panels to form the exterior walls of the building. As shown in FIGS. 1 and 2, a column 20 has a column base 21 that overlies top mounting flanges 16, 17 of sill 10. Along the exterior side of the building, the column base 21 is provided with a taper entry clip 22. The terminal end portion of the taper entry clip 22 is bent downwardly to facilitate the placement of the column in a position overlying sill 10. On the opposite side of the column base from the taper entry clip is a base channel 23 that extends parallel to top mounting flange 16 and has a side wall 24 and bottom wall 25. As shown in FIG. 2, the side wall of channel 23 is tapered at 26 at an angle that is complementary to a wedge 27 that is to be inserted into the channel 23 for securing the column base to the top mounting flanges of the sill.

Wedge 27 has an outwardly extending leg portion 28 that underlies top mounting flange 16 to provide a wedge channel for receiving top mounting flange 16. In order to secure the base of column 20 to the sill 10, wedge 27 is driven inwardly into base channel 23 to force taper entry clip 22 in abutment with top mounting flange 17. This also pulls the base of the column inwardly toward the interior of the building to provide uniform alignment of the columns along the sill. Preferably only frictional engagement between the wedge 27 in channel 23 securely holds the channel to the top mounting flanges 16, 17 of sill 10.

As shown in FIG. 2, it is preferable to provide the tapered wall portion 26 of base channel 23 midway between two taper entry clips 22 to balance the forces acting between column base 21 and top mounting flanges 16, 17. Further, it can be seen that when it is desired to relocate column 20 at another position along sill 10, or to dismantle it from the sill, the wedge merely needs to be driven out of channel 23 to loosen the connection between column base 21 and sill 10. Also, the combination of the wedge and channel engagement of column base 21 to top mounting flange 16 on the one side of the sill, and the taper entry clip engagement of column base 21 to top mounting flange 17 at the other side of the sill, enables the entire mounting connection between columns 20 and sill 10 to be hidden from view, both from the interior and exterior sides of the building. Further, the column is securely mounted on the sill without the need for power driven fasteners or the like.

After the columns have been secured to sill 10, the floor can be installed. The floor is comprised of strips 40 having a multilayer construction. The top and bottom layers 41 and 42 of the floor strips are preferably of a stressed material, such as plywood. Preferably, the floor strips have a honeycomb core filled completely with foam insulation, such as urethane, that also acts as the agent for bonding the top and bottom layers of the multilayer floor strips together. The bottom layer of the floor strips rests upon base plate 12 of sill 10 and the top layer 41 of the floor strips rests adjacent the interior side of the column bases.

The floor extends throughout the entire building between opposite portions of the building perimeter. The floor strips 40 are provided of a convenient width, such as two feet, and have interlocking or interfitting side edges, such as tongue and groove edges. Accordingly, the floor for the building can be installed by assembling the appropriate number of floor strips together edge to edge to span the entire width of the building between opposite columns.

Figure 4:
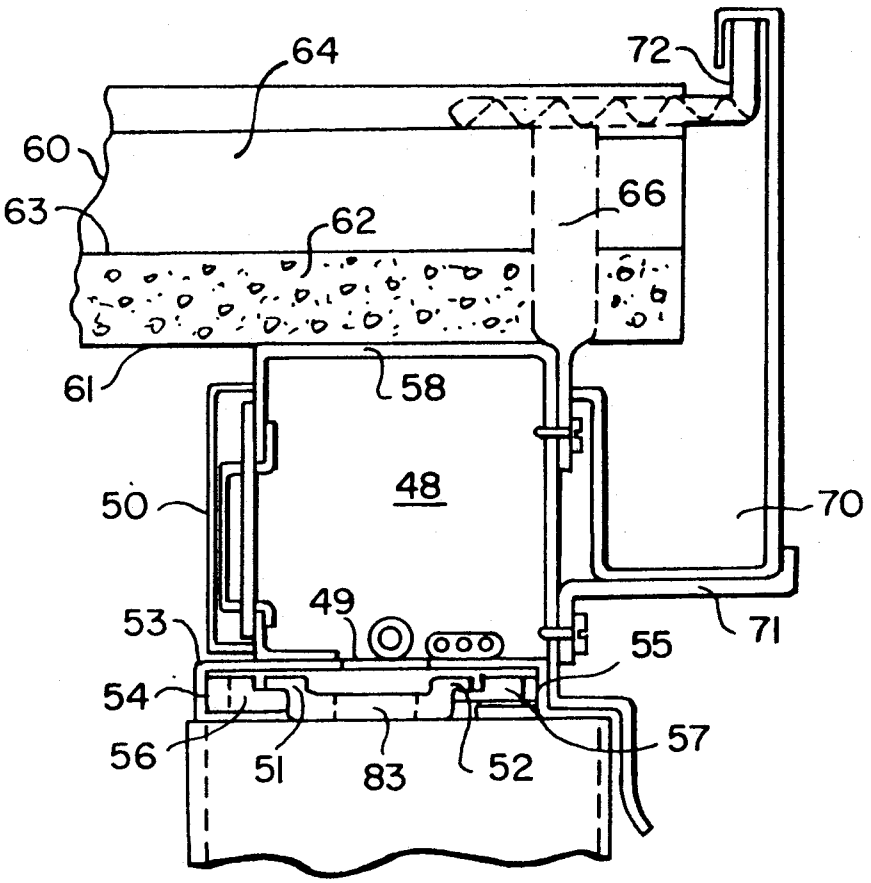
FIG. 4 is an end view of a roof portion of a building constructed according to the present invention.

As shown in FIG. 4, the columns support roof beams 50. Prior to mounting the interior or exterior panels between the columns, the roof beams are secured to the tops of the columns in a way similar to the way in which the column base is mounted to the sill.

The tops of the columns have laterally extending flanges or hooks 51, 52. The roof beams have a base 53 that includes inwardly opening channels 54 and 55 that each include a tapered side wall portion (shown schematically) that is similar to the tapered side wall 26 of column base channel 23. Wedges 56, 57 are driven between lateral flanges 51, 52 into each of channels 54, 55 to secure the roof beam to the top of the channel. As with the manner in which the columns are secured to the sills, the roof beams are secured to the columns in a way that allows removal or replacement of the roof beams by extracting wedges 56, 57 from channels 54, 55.

Figure 5:
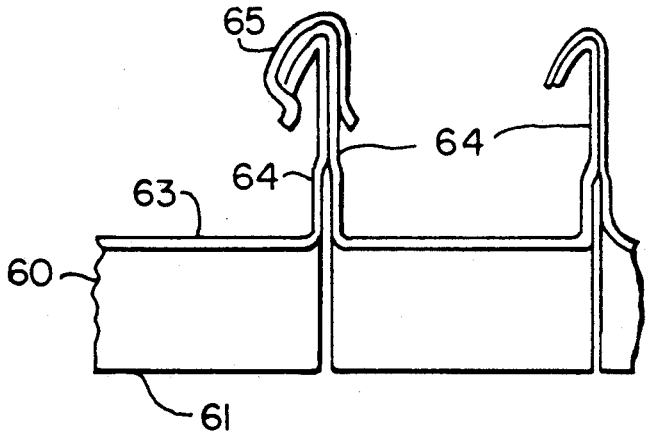
FIG. 5 is an end view of the joining of a plurality of roof strips connected according to the present invention.

The upper part 58 of the roof beams 50 support the multilayer roof strips 60. Roof strips 60 have a multilayer structure that includes an interior skin or surface 61, an intermediate insulating core 62, and a top layer of preferably metal having standing seam side sections 64, as shown in FIG. 5. In constructing the roof, a plurality of roof strips 60 are joined together along adjacent standing seam sections 64 by crimping the standing seam sections together, or by joining them with a clip, as shown at 65 in FIG. 5. To anchor the roof strips to the roof beams 50, a plurality of roof ties 66 are provided. One end of each roof ties is fit between adjacent standing seam sections and incorporated into the joint formed by the clip or crimping operation that joins the adjacent roof strips 60. The other end of the ties 66 are suitably secured to the exterior facing side wall of the roof beams 50, as shown in FIG. 4. In this way, the roof strips are securely anchored to each other and to the roof beams.

The building of the present invention is also provided with gutters 70 having a conventional U-shape, as also shown in FIG. 4. The gutters are supported by a plurality of cantilevered gutter brackets 71 secured to the exterior side of the roof beam and by gutter mounting pins 72 that preferably fit between adjacent standing seam sections of the roof strips. The pins are anchored to the roof strips when the standing seam sections are joined together.

As shown in FIG. 3, columns 20 are constructed of metal having an outer shell 81 and an inner shell 82 that provides the column with the structural strength and stability required for a column. To avoid the drawbacks of metal columns, which include a high degree of heat transfer and a low degree of noise absorption, the space between the outer and inner shells 81 and 82 is filled with an insulating material, such as urethane or cyanurate. Further, the insulating material bonds the inner and outer shells together to form the unitary column structure.

As shown in FIG. 3, the outer shell is basically U-shaped with in-turned leg portions, and the inner shell is basically rectangularly shaped with an open side facing toward the interior of the building. Within the inner shell is a cavity 84 through which electric or water lines can pass. Further, cavity 84 is connected with cavity 18 of sill 10 at the base of the column and with the inner portion of the roof beam cavity 48 through a roof beam aperture 49 that is aligned with a column cavity aperture 83, as shown in FIG. 4. Accordingly, a raceway for accommodating the building's electrical and plumbing needs is formed through the intersection of the cavity of the sill with the column and roof beam cavities such that the raceway extends throughout the perimeter of the building, through each of the columns, and also through each of the roof beams, as necessary.

In accordance with the present invention, the exterior and interior panels of the building 30 and 35 are mounted for relative movement between the columns of the building so that the building can absorb vibrations caused by earthquakes, explosions, heavy machinery and the like. In this regard, as shown in FIG. 3, the outer shell 81 of each column 20 is provided with wing flanges 85, 86 that face inwardly and have seals 87, 88 respectively mounted on the terminal end portions thereof. The exterior surface 31 of exterior panels 30 abuts the seals of the wing flanges. Similarly, the panels are pressed along their interior surface 32 against the seals 93 and 94 of wing flanges 91 and 92 of a molding strip 90. The molding strip 90 spans the width of the inner shell 82 to close off the cavity 84. The mid portion of the molding strip 90 is clamped to a channel 95 formed between the terminal end portions 82*a* of the inner shell by a cam lock 96. The cam lock can be of a conventional design having cammed surfaces that engage end portions 82*a* so that as the lock is turned, the cam lock is wedged in place, as shown. To disengage the cam lock, it is turned 90 degrees with respect to the position shown in FIG. 3 so that the cammed surfaces are freed from engagement with the end portions 82*a*. In this regards, the cammed surfaces have a narrower span between the end portions 82*a* when the cam lock is turned 90 degrees with respect to the position shown in FIG. 3. The molding strip 90 spans the open side of the rectangularly shaped inner shell 81, and when secured by cam lock 96 seals the cavity 83 of column 20 to cover the edges of the panels adjacent the columns. This provides a finished appearance along the joint between the panels and the columns.

The joints between the panels 30 and columns 20 in the construction of the building as shown in FIG. 3, isolates the mass of the panels 30 from the columns 20. Further a space is preferably left between the panels and the columns 20 so that relative movement between the panels and the columns is permitted should vibrations from earthquakes or explosions, for example, cause the building to shake.

As shown in FIG. 3, the panels are easily assembled between the columns without the need for power tools or skilled labor, and although relative movement is permitted between the panels and columns, an effective weather tight seal between the columns and panels is still provided. This is because each of the seals 87, 88 and 93, 94 includes a pair of outer lip seals and an intermediate butt seal for preventing the movement of air between the seals and the panels.

Preferably, the panels 30 are provided with pre-finished exterior and interior surfaces 31 and 32 so that after the panels are assembled between the columns 20, and the molding strips are clamped to bridge the columns 20 between adjacent panels, the interior and exterior surfaces of the walls need no further post-erection work. The interior panels 35 are also preferably prefinished with appropriate outer surfaces or skins 36 and 37. The panels can be prefabricated in a multilayer construction having an insulating and bonding core, preferably of urethane, and an appropriate outer layer that provides the desired exterior and interior wall surfaces respectively.

As shown in FIG. 3, the interior panels are mounted to extend in a lateral direction between oppositely facing columns. To retain the panels, an L-shaped leg 97 engages one surface of interior panel 35 and an oppositely facing retaining member 98 that includes an abutment surface 99 engages the other surface and end edge portion of the panel respectively. Also, a flexible, preferably tubular, seal 100 is provided to seal the joint and provide additional resilient support for the retaining member 98.

Figure 7:
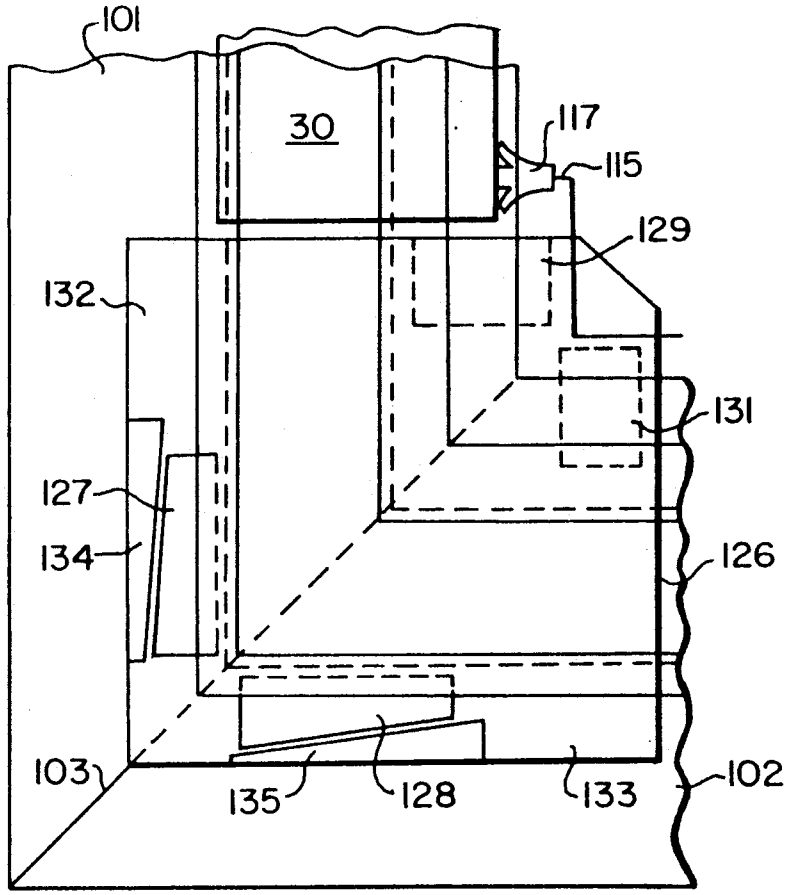
FIG. 7 is a top plan view, shown partly schematically and partly in section, of the mounting connection between the exterior corner column of FIG. 6 and the sill of the building constructed according to the present invention.
Figure 6:
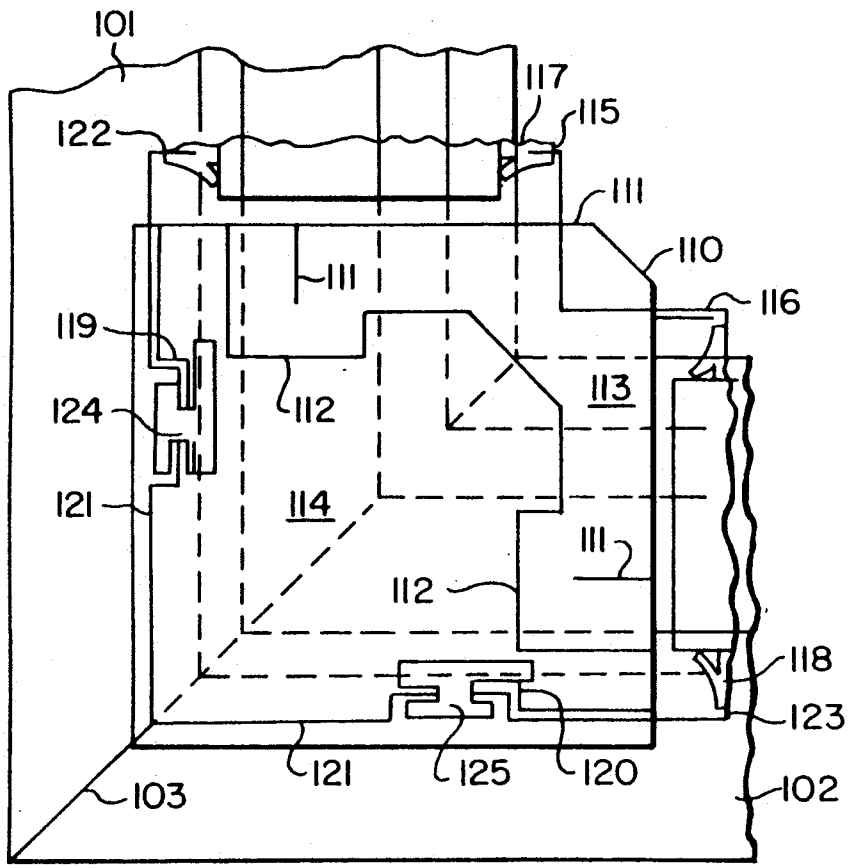
FIG. 6 is a top plan view, shown partly schematically and partly in cross-section, of an exterior corner column and adjacent panels mounted to the column of a building constructed according to the present invention.

In the construction of the building according to the present invention, it may be necessary to provide additional sill structures extending within the perimeter of the building to provide suitable supports for interiorly spaced columns, depending upon the intended size of the building. Preferably, however the building is constructed without the need for sill or foundation beams extending within the perimeter of the building because flexibility in designing the perimeter of the building is provided by including both interior and exterior corner columns that allow for a variety of floor plans to be designed. Up to this point, a discussion has been made only of columns 20 that are intended to support roof beams and panels midway between corners of the building being constructed according to the present invention. In FIGS. 6–9, embodiments of modified columns are presented. In FIGS. 6 and 7, an exterior corner column 110 is disclosed that allows for designing an included 90 degree angle between exterior walls of the building, and in FIGS. 8 and 9 an interior corner column 140 is shown that allows for an included 90 degree angle between interior surfaces of the walls of the building.

As shown schematically in FIG. 6, the exterior corner column 110 is mounted at the junction of two sill beams 101 and 102 that are joined along a 45 degree mitered joint 103. The sill beams 101 and 102 are each of the general construction described with reference to sill 10 and can be joined by an appropriate means, such as by welding.

The exterior corner column 110 of FIG. 6 has an outer shell 111 and an inner shell 112, and an insulating and bonding core material 113 extending between the shells to provide the thermal break and sound absorbing features already discussed. Preferably, the core material is expanded urethane. The inner shell 112 opens inwardly to form a cavity 114 that connects with a cavity formed in sill beams 101 and 102, not shown, but constructed in a like manner to the cavity 18 shown in FIG. 1.

The outer shell 111 of exterior corner column 110 has wing flanges 115, 116 that terminate in end portions having seals 117, 118 that are only partially shown. On the other hand, the terminal portions of the inner shell 111 of the exterior corner column 110 terminate to form cam lock engaging surfaces 119, 120. A molding strip 121 is provided with exterior facing flanges 122, 123 that press against the interior surfaces 32 of exterior panels 30 to push them against the correspondingly opposite wing flanges of the outer shell. The molding strip 121 is clamped to the column along the two adjacent interior surfaces of the column by cam locks 124 and 125, which can be of any conventional suitable design. Thus, the molding strip 121 covers the open cavity 114 formed by inner shell 112 to bridge the interior surfaces of the exterior corner column and press against adjacent exterior panels that are offset with respect to one another by a 90 degree included angle between the exterior surfaces of the panels.

In FIG. 7, mounting of the base 126 of exterior corner column 110 onto the junction of sills 101 and 102 is shown schematically by use of two edges 127 and 128 that cooperate with two taper entry clips 129 and 131 to secure the base 126 to sills 101 and 102. Wedges 127 and 128 are received in two adjacent channels 132 and 133 shown schematically, wherein each of the channels has a tapered side wall 134, 135 respectively that is tapered in a complementary manner to the taper of wedges 127 and 128. Accordingly, driving the wedges in opposite directions within each of the channels pulls the exterior corner column toward the interior of the building and forces the taper entry clips 129 and 131 to abut the corresponding adjacent top mounting flanges of sill beams 101 and 102 to secure the column to the sill beams.

Figure 8:
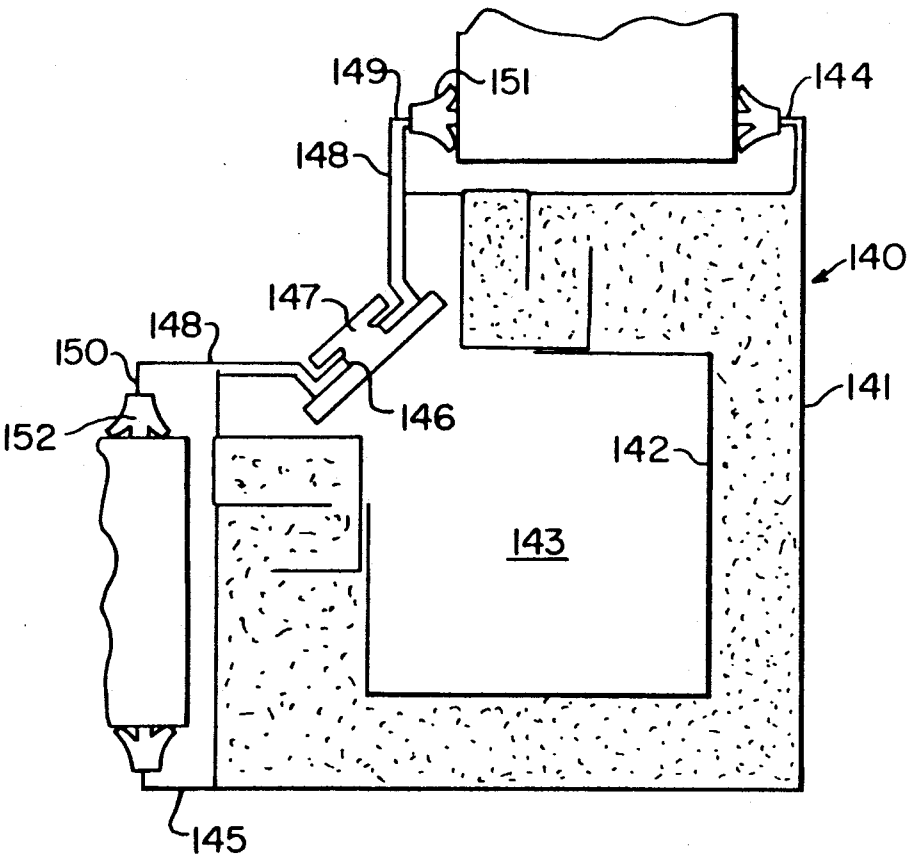
FIG. 8 is a cross-sectional view shown partly schematically of an interior corner column and adjacent panels mounted to the interior corner column, constructed according to the present invention.

In FIG. 8, an interior corner column 140 is shown schematically. The interior corner column has an outer shell 141 and inner shell 142 that is of an open rectangular shape having a cavity 143 formed therein. Wing flanges 144 and 145 are shown schematically as extending inwardly from outer shell 141 with seals on the terminal end portions thereof for engaging the exterior surfaces of panels 30. The inner shell has end portions that terminate to form a channel 146 for receiving a cam lock 147 that secures a molding strip 148 to the column.

Molding strip 148 has exterior facing flanges 149 and 150 having seals 151 and 152 formed at the end portions thereof to engage the interior surface of the panels 30 to press them against the seals of the wing flanges 144 and 145 to thereby mount the panels adjacent to the column in a manner similar to that discussed with reference to the mounting arrangement shown in FIG. 3.

Figure 9:
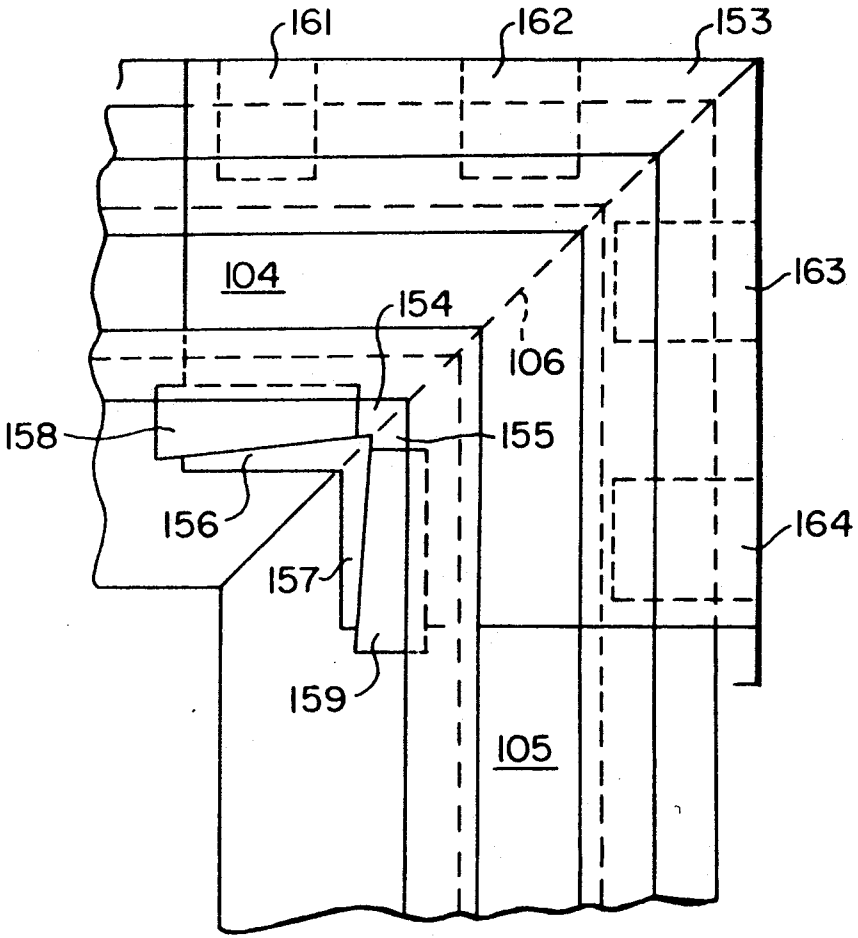
FIG. 9 is a top plan view shown partly schematically and partly in section of the mounting connection between the interior corner column of FIG. 8 and the sill of the invention.

In FIG. 9, sill beams 104 and 105 are shown joined at a 45 degree mitered joint 106. In the base 153 of interior corner column 140 are formed two channels 154 and 155, shown schematically, that have tapered side walls 156 and 157 for accepting wedges 158 and 159, which have a complementary taper. Opposite the base channels 154 and 155 are taper entry clips 161–164 that secure the exterior side of the interior corner column base 153 to the adjacent portions of the top mounting flanges of joined sills 104 and 105. As the wedges are driven in adjacent channels 154 and 155 toward one another, the taper entry clips are pulled inwardly to abut the adjacent portions of the top mounting flanges of sills 104 and 105 thus securing the column base 153 to the joined sill beams.

Figure 10:
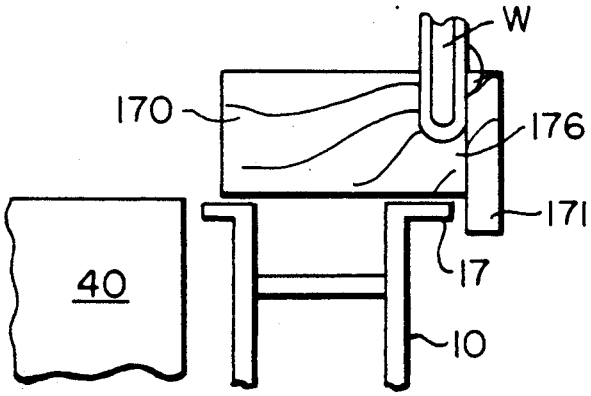
FIG. 10 is a partial cross-sectional view of a panel constructed according to the present invention having a window.

FIG. 10 shows a cross-sectional view of an exterior panel 170 that is similar to panels 30, but of a modified construction. An overhang 171 that is similar to an overhang not shown, but provided for exterior panels 30 overlies the top mounting flange 17 of sill 10. Panel 170 includes an insulated glass window W, partially shown, as an example of a window for the completed building. In this way, it is unnecessary to install windows in the building by forming cutouts in the panels 30 so that time and labor in constructing the building is minimized.

Figure 11:
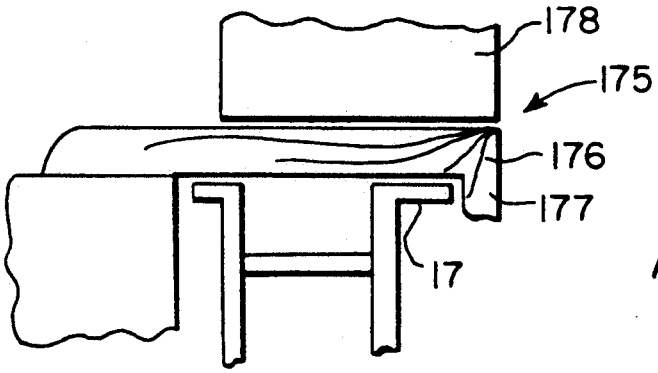
FIG. 11 is a partial cross-sectional view of a panel constructed according to the present invention that includes a door.

In FIG. 11, another modified panel 175 is shown having a bottom portion 176 that includes an overhang 177 that overhangs a top mounting flange 17 of sill 10. The bottom portion 176 constitutes a threshold plate for a rough door frame 178 that extends across the top of sill 10 to overly a portion of joined floor strips 40. Accordingly, by providing panel 175, it is unnecessary to form cutouts in panels 30 to provide doorways into the building thus minimizing the construction time and labor requirements for constructing the building.

In view of the foregoing discussion of the preferred embodiments of the invention, the invention can be practiced with many modifications without exceeding the scope of the appended claims, therefore the invention is defined according to the appended claims.

What is claimed is:

1. A building having a footing, comprising:

a sill having a base supported on said footing, an upwardly extending body portion having a cavity formed therein, and top mounting flanges, said sill extending about the perimeter of said building;

a plurality of columns, each said column having a base and means for mounting said column base to said top mounting flanges of said sill, said column further having a second cavity intersecting with said cavity of said sill for forming a continuous raceway in said sill and extending upwardly from said sill through each of said columns;

said column base having an exterior and interior sides, said base having a taper entry clip adjacent said exterior side and said base having a channel adjacent said interior side opening toward and extending parallel with said sill top flanges; and said means for mounting said column base to said sill including wedge means for fitting in said column base channel and abutting the adjacent one of said sill top flanges such that driving said wedge into said column base channel forces said taper entry clip in abutment with the other of said top flanges to secure said column base to said sill and further such that said wedge is hidden from view by said column base channel.

2. A building, according to claim 1, further comprising:

each of said columns being constructed of steel, said exterior side having first wing flanges extending from each side of each said column, each of said first wing flanges terminating in a sealing surface extending inwardly;

means for mounting at least one panel between each of a pair of said columns to permit relative movement between said columns and said panels, said panels having exterior and interior sides wherein the exterior side abuts said sealing surface of said first wing flanges;

said means for mounting including first means for pressing said interior side of said panel toward said sealing surface of said first wing flanges, said pressing means being secured to said column such that said panel is held adjacent to said column between said first pressing means and said wing flanges, said mounting means further for isolating the mass of said panel from said columns.

3. A building according to claim 2, further comprising:

a roof including roof beams and roof strips supported on said roof beams;

each said column having a roof beam support surface and laterally extending flanges extending toward said exterior and interior sides respectively and an aperture extending through the top of said column;

each said roof beam having a central cavity and an aperture aligned with said column aperture for extending said raceway from said columns through said roof beams;

each said roof beam having means for mounting said roof beam to said laterally extending flanges including said roof beam having inwardly opening channels facing each of said laterally extending flanges and wedge means for fitting into each of said channels and abutting the respective one of said laterally extending flanges such that as said wedge means are driven into said channels said wedge means frictionally secure said laterally extending flanges against relative movement with respect to said inwardly facing channels of said roof beam to secure said roof beams to said columns.

4. The building according to claim 3, wherein said roof strips have a bonded multilayer structure including an exterior exposed metal upper layer, an intermediate insulating layer bonded to said metal upper layer and a cover sheet bonded to said insulating layer, and said strips having upstanding forming sections on each side of said strips that abut one another when said roof strips are positioned along said roof beams in side by side relationship to form a roof such that said upstanding seam sections can be joined together to form a continuous roof from a plurality of said roof strips.

5. The building according to claim 4, further comprising:

gutters having a U-shape having opposite leg end portions, one of said leg end portions being secured to the exterior side of said roof beam and the other of said leg portions being secured to said roof strips;

mounting bracket means for supporting said gutter secured to said roof beam; and a plurality of roof ties having opposite ends wherein one of said ends is secured to said roof beam and the other of said ends extends between said seam sections such that the other of said ends of each said roof tie is secured in the seam formed between adjacent said roof strips.

6. The building according to claim 3, further comprising:

each said roof beam having an exterior downwardly depending flange overlying the exterior side of said column for sealing the joint between said roof beam and said column; and said roof beam further having a box shape such that said cavity is formed interiorly of said box and access to said cavity can be attained through an access hole formed in the interior side of the roof beam and a cover with retaining means for retaining said cover in place over said access hole to cover said access hole.

7. A building according to claim 3, wherein predetermined ones of said columns are exterior corner columns having two adjacent interior facing sides and a base having a channel formed adjacent each of said interior sides;

each of said channels having a tapered wall facing an adjacent portion of a respective one of said sill top flanges to receive a wedge between said tapered wall and said respective sill top flange such that two wedges secure said exterior corner columns to said sill.

8. A building according to claim 7, further comprising:

said exterior corner columns each having an outer and inner shell with an insulating and bonding material for bonding said outer and inner shells together, said outer and inner shells positioned adjacent one another without contacting one another such that a thermal break is formed between said shells by said insulating material, said inner shell forming a cavity that joins said sill cavity to form said raceway, and said outer shell having second panel engaging inwardly facing wing flanges having seals for supporting the exterior side of said panels when said panels are pressed against said second wing flanges; and second means for pressing said panels said second wing flanges including a second molding strip extending across said interior sides of said exterior corner column, and means for securing said second molding strip to each of said interior sides of said exterior corner column, said molding strip further including side edges terminating in exteriorly facing flanges, said exteriorly facing flanges having seals for pressing the interior sides of said adjacent panels such that said panels are pressed against said inwardly facing flanges to support said panels adjacent said exterior corner column for isolating the mass of said panels from the mass of said exterior corner column.

9. A building according to claim 3, further comprising:

predetermined ones of said columns being interior corner columns having a base including an interiorly facing corner portion having two channels intersecting one another at a right angle, the side wall of the each said channels facing an adjacent portion of the top flange of said sill, said channels being tapered to receive a complimentary tapered surface of a wedge such that said interior corner column is secured to said sill by two wedges driven into said channels at right angles to one another.

10. A building according to claim 9, further comprising each said interior corner column having outer and inner shells with an urethane insulating material formed between each of said shells for bonding said shells to one another without contact between said shells.

11. The building according to claim 3, further comprising each said column having outer and inner shells with an insulating material formed thereinbetween, said insulating material bonding said outer and inner shells together to prevent contact between said outer and inner shells such that a thermal break is formed between said shells.

12. The building according to claim 11, wherein said outer shell has a U-shape, said inwardly facing first wing flanges being fixed to said outer shell, and said inner shell has an open rectangular shape facing inwardly to form said cavity and a channel for anchoring said first pressing means.

13. A building according to claim 2, further comprising:

interior panels extending between opposed ones of said columns, said interior panels having a multilayer structure including opposite face sheet layers bonded together by a urethane core;

said first means for pressing including means for engaging each of said face sheet layers of said interior panels for supporting said interior panels to form interior walls of said building.

14. A building according to claim 2, wherein predetermined ones of said panels include windows and doors respectively for forming windows and doors of said building.

15. A building according to claim 2, further comprising:

said first pressing means having a longitudinally extending molding strip having opposite sides terminating in outwardly extending flanges and cam lock means for securing said molding strips to said columns such that each said molding strip bridges one of said columns to extend between adjacent ones of said panels held in position adjacent to the opposite sides of said one column.

16. A building according to claim 1, further comprising a floor including floor strips extending longitudinally and having interfitting edges such that a plurality of said strips can be joined side by side to extend between opposite portions of said sill, each of said floor strips having a bonded multilayer structure including a top interior floor covering layer of a stressed material, a bottom earth facing stressed material and an intermediate honeycomb core of insulating and bonding urethane that bonds said top and bottom layers together, said bottom layer being supported on said base of said sill and said top layer forming the floor of said building.

* * * * *